US005426870A

United States Patent [19]

Purnell et al.

[11] Patent Number: 5,426,870

[45] Date of Patent: Jun. 27, 1995

[54] ANTISTATIC SHOE SOLE

[75] Inventors: Andrew T. Purnell, Research; Robert D. Purnell, North Balwyn, both of Australia

[73] Assignee: Phurness Pty. Ltd., Eltham, Australia

[21] Appl. No.: 150,058

[22] PCT Filed: May 18, 1992

[86] PCT No.: PCT/AU92/00223

§ 371 Date: Jan. 21, 1994

§ 102(e) Date: Jan. 21, 1994

[87] PCT Pub. No.: WO92/20249

PCT Pub. Date: Nov. 26, 1992

[30] Foreign Application Priority Data

May 17, 1991 [AU] Australia ..... PK6225

[51] Int. Cl.[6] ..... A43B 13/02; A43B 13/04; A43B 13/12

[52] U.S. Cl. ..... 36/84; 36/87; 36/30 R; 36/25 R; 361/223

[58] Field of Search ..... 36/84, 87, 30 A, 25 R, 36/31, 114, 30 R, 7.1 R, 71; 361/223, 224

[56] References Cited

U.S. PATENT DOCUMENTS

| | | | |
|---|---|---|---|
| 2,798,312 | 7/1957 | Muller | 36/87 |
| 2,958,012 | 10/1960 | Melman et al. | 36/7.1 R |
| 3,273,265 | 9/1966 | Reinert et al. | 36/28 |
| 4,455,765 | 6/1984 | Sjöswärd | 36/114 |
| 4,502,234 | 3/1985 | Schaefer et al. | 36/28 |
| 4,594,367 | 6/1986 | Geissel et al. | 36/87 |
| 4,689,900 | 9/1987 | Ishibashi | 36/30 A |
| 4,858,337 | 8/1989 | Barma | 36/30 R |
| 4,858,340 | 8/1989 | Pasternak | 36/30 R |
| 5,254,405 | 10/1993 | Panaroni et al. | 36/25 R |

FOREIGN PATENT DOCUMENTS

| | | |
|---|---|---|
| 847437 | 2/1977 | Belgium . |
| 79572 | 11/1982 | European Pat. Off. . |
| 2147904 | 3/1973 | Germany . |
| 3827598 | 8/1988 | Germany . |
| 91/02469 | 3/1991 | WIPO . |

OTHER PUBLICATIONS

Derwent Abstract Accession No. 78-35932A/20 Class A83 JP,A, 53-038453 (Hiroshima Kasei KK) 8 Apr. 1978.

Derwent Abstract Accession No. 85-234384/38 Class P22 JP,A, 60-153802 (Tsukihoshi Kasei KK) 13 Aug. 1985.

Derwent Abstract Accession No. 88-061922/09 Class P22 JP,A,63-019102 (Hiroshima Kasei KK) 26 Jan. 1988.

Derwent Abstract Accession No. 88-351049/49 Class P22 JP,A, 63-264002 (Seiaicho Rubber KK) 31 Oct. 1988.

Derwent Abstract Accession No. 90-352520/47 Class P22 JP,A, 02-255102 (Kokoku Chem Ind KK) 15 Oct. 1990.

*Primary Examiner*—Jimmy G. Foster
*Assistant Examiner*—Marie Denise Patterson
*Attorney, Agent, or Firm*—Larson & Taylor

[57] ABSTRACT

A shoe sole construction comprises a polyurethane outer sole having an electrical resistance of approximately 40 MOhms in a standard wet/dry test and an electrical resistance of approximately 20 MOhms in a standard wet/wet test in a test conducted according to British Standard 2050, and a rubber sole insert having an electrical resistance of approximately 1 MOhm positioned adjacent the outer sole. With this construction, static electricity in the sole insert is capable of discharging from the sole insert along a path of least resistance through the outer sole.

9 Claims, 2 Drawing Sheets

ANTISTATIC SHOE SOLE

BACKGROUND OF THE INVENTION

The present invention relates to an antistatic shoe sole.

In the manufacture of some products, for example electronic devices, stray static electricity can damage or significantly disrupt the operation of the products. Sensitive computers, integrated circuits and computer software and data which are stored on magnetic tape or disk may even be destroyed by stray static electricity. Consequently, extensive measures are taken during the manufacture and use of these products in order to reduce the risks of damage by stray static electricity. People using and manufacturing the products are usually one of the most significant sources of stray static electricity. Consequently, it is essential to discharge static electricity from people who may come in contact with products which may be adversely effected by static electricity. Usually working areas in which such products can be found have a grounded floor or grounded mats which are able to discharge the static electricity from people walking on the floor or mats by conducting the static electricity from the people to the floor. The only contact people have with the floor is usually through their shoe soles, but static electricity does not readily discharge through conventional shoe soles since the shoe soles do not adequately conduct static electricity from the body of the person to the floor. Therefore, in order to improve static electricity discharge it is desirable to have an antistatic shoe which readily discharges static electricity.

DISCUSSION OF PRIOR ART

It is known to produce antistatic shoes with rubber soles, but these shoes suffer from a number of disadvantages. Rubber soles are often heavy and may mark floors. In order to overcome these problems, it is preferably to use polyurethane rather than rubber, since polyurethane is a lighter product which lasts longer and is non-marking. However, polyurethane is not within the desired range of electrical resistance for conducting static electricity. Antistatic shoes usually have an electrical resistance property of between 75 kOhms and 50 MOhms, (as measured by the standard test specified in British Standard 2050). Polyurethane does not have these resistance properties and it is therefore necessary to enhance the antistatic properties of the polyurethane by the introduction of additives to the polyurethane. However, polyurethane is a blown material and the dispersion of additives within the material is not homogenous due to the poor mixing characteristics of polyurethane. Furthermore, in order to achieve adequate antistatic properties it is necessary to add a large amount of additives, but this deteriorates the quality of the polyurethane. Consequently, simply adding antistatic additives to polyurethane to make an antistatic polyurethane shoe sole is not possible.

SUMMARY OF THE INVENTION

The present invention attempts to overcome one or more of the above problems.

According to the present invention there is provided a shoe sole comprising:

a polyurethane outer sole having predetermined electrical resistance characteristics, and a rubber sole insert having predetermined electrical resistance characteristics positioned adjacent the outer sole, wherein, static electricity in the sole insert is capable of discharging from the sole insert along a path of least resistance through the outer sole.

It is preferred that the shoe sole further comprises a conductive inner sole positioned adjacent the sole insert so as to improve the discharge of static electricity from a wearer of a shoe having the shoe sole through the inner sole, the sole insert and the outer sole.

DESCRIPTION OF THE DRAWINGS

Preferred embodiments of the present invention will now be described, by way of example only, with reference to the accompanying drawings, in which.

DETAILED DESCRIPTION OF THE PREFERRED EMBODIMENT

Figure 1:
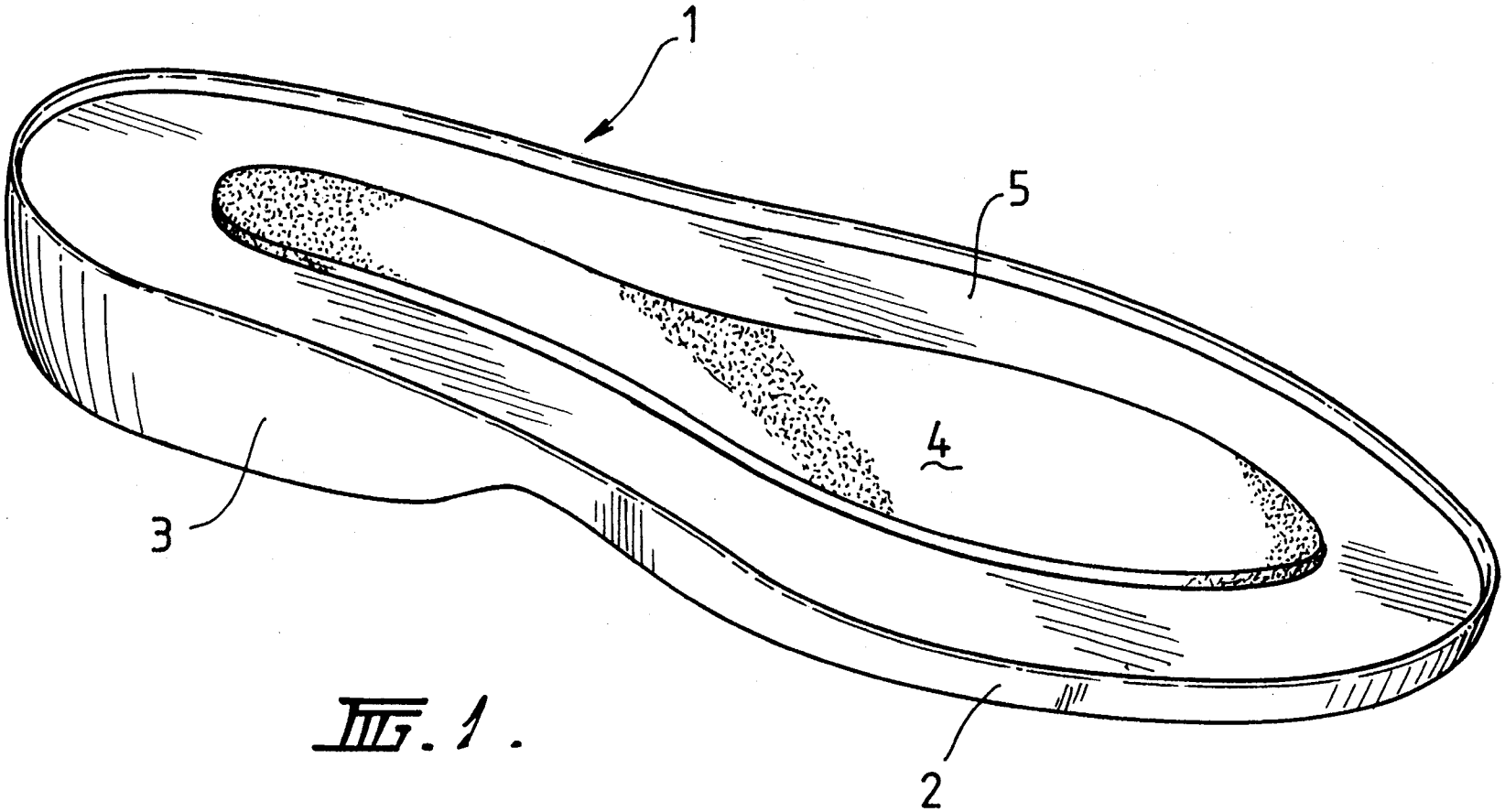
FIG. 1 is a perspective view of a preferred embodiment of the present invention.
Figure 2:
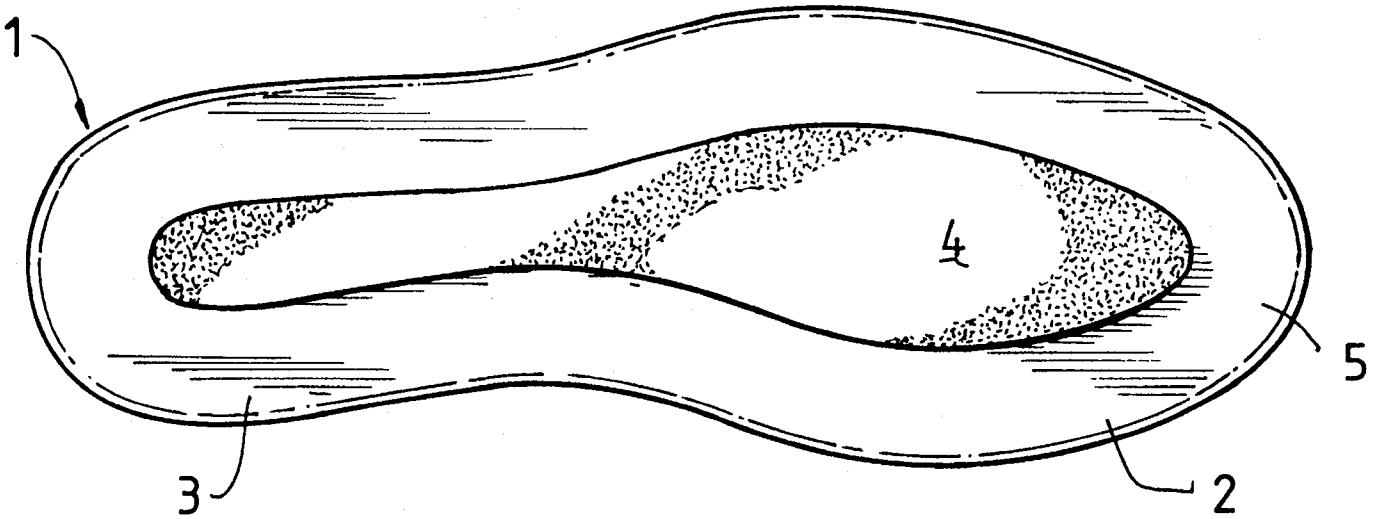
FIG. 2 is a top view of the sole of FIG. 1.
Figure 3:
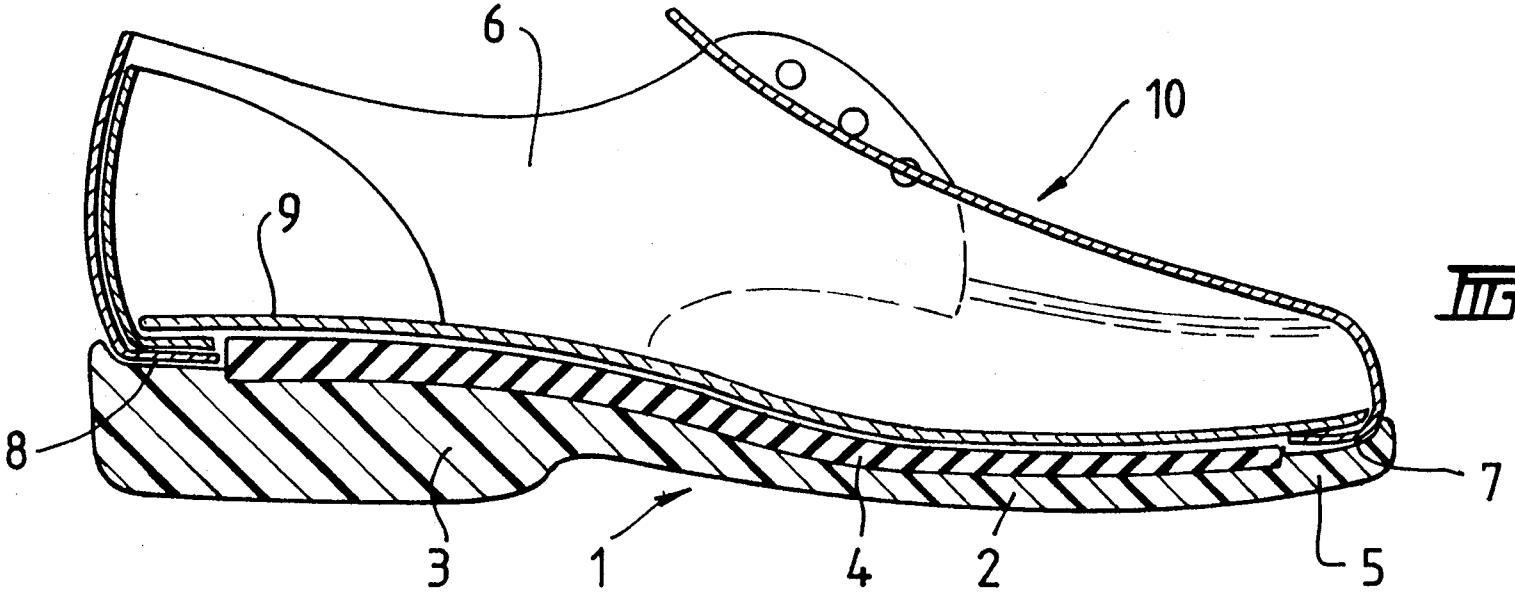
FIG. 3 is a preferred embodiment of a shoe having an antistatic sole of FIG. 1.

The preferred embodiment of the shoe sole 1, as illustrated in FIGS. 1, 2 and 3, is comprised of an outer sole 2 and a sole insert 4. The shoe sole 1 comprises a heel section 3 and a toe section 5. The sole insert 4 is comprised of a strip of rubber which is smaller than the shoe sole, but of a similar shape. The sole insert 4 extends substantially along the centre of the outer sole 2, from about the centre of the heel section 3 towards the toe section 5 of the shoe sole. The sole insert 4 is recessed in the outer sole 2 to prevent movement of the sole insert 4.

The outer sole 2 is manufactured from a microcellular polyurethane containing approximately 5% of quaternary ammonium, or a similar compound, and 2 to 3% carbon black to impart electrical resistance characteristics to the polyurethane material for the necessary antistatic properties. The additive is supplied by ICI Australia Limited under the trade mark "Additive I". This polyurethane sole has a resistance of approximately 40 MOhms in a standard wet/dry test and a resistance of 20 MOhms in a wet/wet test conducted according to British Standard 2050. In general, the resistance cannot be reduced any further since a maximum of approximately 10% additives can be added to polyurethane before it starts to break down. Therefore, the resistance of the polyurethane is reduced as far as possible, but since the improved electrical resistance characteristics are still not adequate for an antistatic shoe sole, the characteristics have to be improved with the aid of a sole insert 4 having a lower electrical resistance. The combination of the outer sole 2 and the sole insert 4 thus provides an antistatic shoe sole with the required electrical resistance characteristics.

The sole insert 4 is manufactured from a rubber containing various additives which results in a sole insert with a resistance of approximately 1 MOhms. Because rubber does not suffer from poor mixing, as polyurethane does, the additives are dispersed evenly through the insert resulting in even conductivity. Furthermore, the rubber can be given more additives than polyurethane, therefore resulting in a much lower resistance value compared to polyurethane. The base formulation for the antistatic rubber insert is as follows:

| | |
|---|---|
| Natural Rubber SMR20 | 80.00 |
| Synthetic Rubber SBR1502 | 20.00 |
| Zinc Oxide | 5.00 |
| Stearic Acid | 1.00 |
| Antioxidant TMQ | 1.00 |
| Accelerator CBS | 1.50 |
| Accelerator DPG | 0.25 |
| Carbon Black N220 | 10.00 |
| Carbon Black N774 | 55.00 |
| Aromatic Oil | 8.00 |
| Sulphur | 2.00 |
| | 183.75 |

Carbon black is a substantially pure form of finely divided carbon. Carbon black N220 is a conductive black and its proportions to carbon black N774 are adjusted to provide the required electrical resistance. Increasing the amount of carbon black N220, provides a lower resistance value for the rubber.

In use, static electricity from a person wearing a shoe having the shoe sole of the preferred embodiment of the present invention, collects in the sole insert 4. In order to discharge to the ground, the static electricity finds a path of least resistance through the polyurethane outer sole 2. This location would usually be near the toe of the shoe, since the shoe sole is at its thinnest point in this area. However, due to the uneven mixing of the antistatic additives within the polyurethane, the path of least resistance is not always the shortest path in distance through the shoe sole, but rather the path which is most conductive to electricity. If static electricity builds up in the heel 3 of the shoe sole 1, then the static electricity will most likely flow further down the sole insert 4 and find a discharge path through the thinner toe section 5 of the outer sole 2. In the preferred embodiment the thickness of the sole is at least 2 to 3 millimeters.

FIG. 4 illustrates a shoe 10 having an outer sole 2 in accordance with a preferred embodiment of the present invention. The shoe 10 has a leather upper 6 with a polyurethane outer sole 2, as described above. In order to improve the conductance of static electricity from a wearer of the shoe to the shoe sole, the shoe is provided with a conductive inner sole 9 which is in direct contact with the sole insert 4. The leather outer 6 is tucked under the insole 9, as shown at 7 and 8, and continues around the circumference of the shoe sole so that the leather abuts the sole insert 4. In use, static electricity flows from the body of a wearer of the shoe, through the conductive inner sole 9 to the sole insert 4 and then through the polyurethane outer sole 2 along a path of least resistance.

The polyurethane outer sole has advantages over the prior art rubber soles in that the polyurethane soles are non-marking, have better antislip characteristics, last longer and are lighter to wear. Furthermore, unlike rubber, the polyurethane sole is resistant to petrochemicals and acids, thus making it ideal in hazardous environments.

It will be appreciated that features of the above invention may be varied for different applications the foregone description of the embodiments of the invention have been presented for purposes of illustration only. It is not intended to be exhaustive or to limit the invention to the embodiments, and many variations and modifications will be obvious to one skilled in the art.

We claim:

1. A shoe sole comprising: a polyurethane outer sole having an electrical resistance of approximately 40 MOhms in a standard wet/dry test and an electrical resistance of approximately 20 MOhms in a standard wet/wet test conducted according to British Standard 2050, and a rubber sole insert having an electrical resistance of approximately 1 MOhm positioned adjacent the outer sole such that static electricity in the sole insert is capable of discharging from the sole insert along a path of least resistance through the outer sole.

2. A shoe sole according to claim 1, wherein the sole insert comprises a strip extending substantially along the center and on an inner surface of the outer sole.

3. A shoe sole according to claim 2, wherein the sole insert extends from the heel of the shoe sole to the toe of the shoe sole.

4. A shoe sole according to claim 2, wherein the outer sole has a central recess in the inner surface thereof and the sole insert is located in the central recess.

5. A shoe sole according to claim 1, further comprising a conductive inner sole positioned adjacent the sole insert.

6. A shoe sole according to claim 1, wherein the outer sole is comprised of polyurethane having approximately 5% quaternary ammonium at 2 to 3% carbon black.

7. A shoe sole according to claim 1, wherein the sole insert is comprised of a rubber material having approximately 5% carbon black N220.

8. A shoe sole according to claim 1, wherein the outer sole has a thickness of at least 2 mm.

9. A shoe including a shoe sole comprising: a polyurethane outer sole having an electrical resistance of approximately 40 MOhms in a standard wet/dry test and an electrical resistance of approximately 20 MOhms in a standard wet/wet test conducted according to British Standard 2050, and a rubber sole insert having an electrical resistance of approximately 1 MOhm positioned adjacent the outer sole such that static electricity in the sole insert is capable of discharging from the sole insert along a path of least resistance through the outer sole.

* * * * *